US006742584B1

(12) United States Patent
Appleton

(10) Patent No.: US 6,742,584 B1
(45) Date of Patent: Jun. 1, 2004

(54) APPARATUS FOR FACILITATING THE CONNECTION OF TUBULARS USING A TOP DRIVE

(75) Inventor: Robert Patrick Appleton, Aberdeenshire (GB)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 09/787,597

(22) PCT Filed: Sep. 27, 1999

(86) PCT No.: PCT/GB99/03014

§ 371 (c)(1),
(2), (4) Date: Jul. 11, 2001

(87) PCT Pub. No.: WO00/19058

PCT Pub. Date: Apr. 6, 2000

(30) Foreign Application Priority Data

Sep. 25, 1998 (GB) ..... 9820802

(51) Int. Cl.[7] ..... E21B 31/20

(52) U.S. Cl. ..... 166/98; 166/77.51; 294/86.24

(58) Field of Search ..... 166/77.1, 77.51, 166/85.1, 98, 212, 214; 175/230; 294/86.15, 86.24, 86.25

(56) References Cited

U.S. PATENT DOCUMENTS

| | | | | |
|---|---|---|---|---|
| 1,436,246 A | | 11/1922 | Greve | |
| 1,917,135 A | | 7/1933 | Littell | |
| 2,184,681 A | * | 12/1939 | Osmun et al. | 294/102.1 |
| 3,380,528 A | | 4/1968 | Timmons | |

(List continued on next page.)

FOREIGN PATENT DOCUMENTS

| | | |
|---|---|---|
| EP | 0 525 247 A1 | 8/1991 |
| GB | 2 224 481 A | 5/1990 |
| GB | 2 275 486 A | 8/1994 |
| GB | 2 310 678 | 3/1997 |
| WO | WO 93/07358 A1 | 4/1993 |
| WO | WO 96/07009 A2 | 3/1996 |
| WO | WO 96/18799 | 6/1996 |
| WO | WO 98/05844 | 2/1998 |
| WO | WO 98/11322 | 3/1998 |
| WO | WO 00/05483 | 3/2000 |

OTHER PUBLICATIONS

U.S. application No. 09/918,233, filed Jul. 30, 2001 in the name of Robert Appleton.

Preliminary Amendment dated Jul. 30, 2001, for U.S. patent application No. 09/918,233, filed Jul. 30, 2001, In re: Appleton, entitled "An Apparatus for Facilitating the Connection of Tubulars Using a Top Drive".

Office Action dated Dec. 4, 2001, for U.S. patent application No. 09/918,233, filed Jul. 30, 2001, In re: Appleton, entitled "An Apparatus for Facilitating the Connection of Tubulars Using a Top Drive".

Amendment dated May 6, 2002, for U.S. patent application No. 09/918,233, filed Jul. 30, 2001, In re: Appleton, entitled "An Apparatus for Facilitating the Connection of Tubulars Using a Top Drive".

Office Action dated Jun. 6, 2002, for U.S. patent application No. 09/918,233, filed Jul. 30, 2001, In re: Appleton, entitled "An Apparatus for Facilitating the Connection of Tubulars Using a Top Drive".

*Primary Examiner*—David Bagnell
*Assistant Examiner*—Daniel P Stephenson
(74) *Attorney, Agent, or Firm*—Alston & Bird LLP

(57) ABSTRACT

An apparatus for facilitating the connection of tubulars using a top drive, which apparatus comprises a body (2; 102) connectable to said top drive, said body (2; 102) comprising at least one gripping element (5; 105) radially displaceable by hydraulic or pneumatic fluid to drivingly engage said tubular (30; 110) to permit a screw connection between said tubular and a further tubular to be tightened to the required torque.

16 Claims, 2 Drawing Sheets

U.S. PATENT DOCUMENTS

| | | | | | |
|---|---|---|---|---|---|
| 3,552,507 | A | | 1/1971 | Brown | |
| 3,570,598 | A | | 3/1971 | Johnson | |
| 3,638,989 | A | * | 2/1972 | Sandquist | 166/212 |
| 4,074,774 | A | | 2/1978 | Brown | |
| 4,100,968 | A | * | 7/1978 | Delano | 166/380 |
| 4,287,949 | A | | 9/1981 | Lindsey, Jr. | |
| 4,320,915 | A | | 3/1982 | Abbott et al. | |
| 4,449,596 | A | * | 5/1984 | Boyadjieff | 175/85 |
| 4,580,631 | A | | 4/1986 | Baugh | |
| 4,605,077 | A | | 8/1986 | Boyadjieff | |
| 4,711,303 | A | * | 12/1987 | Koeling et al. | 166/250.01 |
| 4,762,187 | A | | 8/1988 | Haney | |
| 4,997,042 | A | | 3/1991 | Jordan et al. | |
| 5,009,265 | A | | 4/1991 | Bailey et al. | |
| 5,191,939 | A | | 3/1993 | Stokley | |
| 5,255,751 | A | | 10/1993 | Stogner | |
| 5,297,833 | A | | 3/1994 | Willis et al. | |
| 5,501,280 | A | * | 3/1996 | Brisco | 166/324 |
| 5,553,672 | A | | 9/1996 | Smith, Jr. et al. | |
| 5,584,343 | A | | 12/1996 | Coone | |
| 5,735,348 | A | | 4/1998 | Hawkins, III | |
| 5,765,638 | A | * | 6/1998 | Taylor | 166/115 |
| 5,971,079 | A | | 10/1999 | Mullins | |
| 6,000,472 | A | | 12/1999 | Albright et al. | |

* cited by examiner

APPARATUS FOR FACILITATING THE CONNECTION OF TUBULARS USING A TOP DRIVE

This invention relates to an apparatus for facilitating the connection of tubulars using a top drive and is more particularly, but not exclusively, intended for facilitating the connection of a section or stand of casing to a string of casing.

In the construction of oil or gas wells it is usually necessary to line the borehole with a string of tubulars known as casing. Because of the length of the casing required, sections or stands of say two sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well centre above the spider. The threaded pin of the section or stand of casing to be connected is then located over the threaded box of the casing in the well and the connection is made up by rotation therebetween. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection. A "top drive" is a top driven rotational system substantially used for drilling purposes, assigned to the drawworks at a higher level than the elevator, as is previously known.

Because of the high costs associated with the construction of oil and gas wells time is critical and it has been observed by the applicants that the time to connect a tubular to a top drive using existing equipment could be reduced.

According to a first aspect of the present invention, there is provided a tool that will facilitate the running of a casing string into a well bore, comprising:

(a) a grapple machined with both horizontal and vertical "whickers" or serrated teeth for gripping the tubular innerwall, complete with a wedge locking mechanism;

(b) a hydraulic mechanism for locking and unlocking the grapple and wedge lock mechanism, thus providing a "positive lock" situation;

(c) a compression spring provided within the hydraulic lock piston applying positive locking to the grapple and wedge lock arrangement;

(d) a check valve that will prevent mud spillage during casing fillup and circulation;

(e) an inflatable or pressure operated pack-off that will permit fillup or casing circulation to take place at any given time once installed within the casing string; and (f) a connection for connecting the device to the rig based equipment for running casing into a well bore.

According to a second aspect of the present invention there is provided apparatus (201) for running tubulars (213) into a borehole, said apparatus comprising a body (202) provided with a wedge lock assembly (212) and a hydraulically operable grapple (210) to mechanically grip the inside wall of a tubular (213) to be run into, or withdrawn from, the borehole, said grapple incorporating positive locking means to prevent inadvertent release of said grapple, said body further comprising means (214) to prevent spillage of drilling fluid when the body is withdrawn from the tubular, a sealing packer (215) for engagement with the tubular to permit fluid to be circulated within the tubular, and a stabbing guide (216), characterised in that said grapple (210) comprises horizontally and/or vertically aligned whickers or serrated machined teeth and said stabbing guide is a rubber stabbing guide to prevent damage when entering a tubular.

In use, such an apparatus may be connected to a top-drive unit via a threaded connection, or to a kelly driven rig via a pump joint latched into an elevator. Both systems have available a means of connecting up to a circulating system that will permit the casing to be filled or circulated at any time during the running operation.

Casing is normally run by picking up a joint at a time, utilising single pickup elevators to bring the joint into the derrick and connect it to the previously run joint, whether it be by threaded connection or "mechanical latching or locking". The two joints are either screwed or locked together and then lowered into the well bore using elevators.

With heavy casing strings it is required that very large elevators are used to be able to handle the load. This often means that the top of the casing joint must be set 8–10 feet above the rig floor to permit disengagement to take place. Scaffolding is often required for the rig crews to be able to stab or connect the next joint to the string. It is also normal to either utilise a separate pack-off assembly, or a fillup hose that must be installed by the rig crew after it has been lowered and set in the slips.

Preferred embodiments of the present invention will permit the casing to be picked up by single pickup elevators, connected either by rotation or mechanical latch, and then the casing running tool to be "stabbed" into the bore of the top joint without damage, due to the rubber bull-nose guide. When the tool is at the correct depth of penetration within the casing bore, the hydraulic piston is actuated to drive the grapple down onto the wedge lock and secure the grapple to the casing wall. As the casing string is lifted, the wedge-lock continues to drive into the grapple bore, providing an ever increasing wedge lock. The compression spring installed within the hydraulic piston provides a "positive-lock" or failsafe should the hydraulic system fail for any reason.

When the apparatus is engaged, it is then possible to push, pull, or even rotate the casing string. A seal ring assembly is required to rotate the casing string, to permit constant control of the hydraulic actuating piston to be maintained.

Preferred embodiments of the apparatus are equipped with a through-bore to permit casing fillup and circulation to take place at any time. There may also be provided a pack-off that can be either inflatable or flow pressure operated.

The present invention also provides a top drive having an apparatus in accordance with the present invention attached thereto.

Some preferred embodiments of the invention will now be described, by way of example only, with reference to the accompanying drawings, in which.

Figure 1:
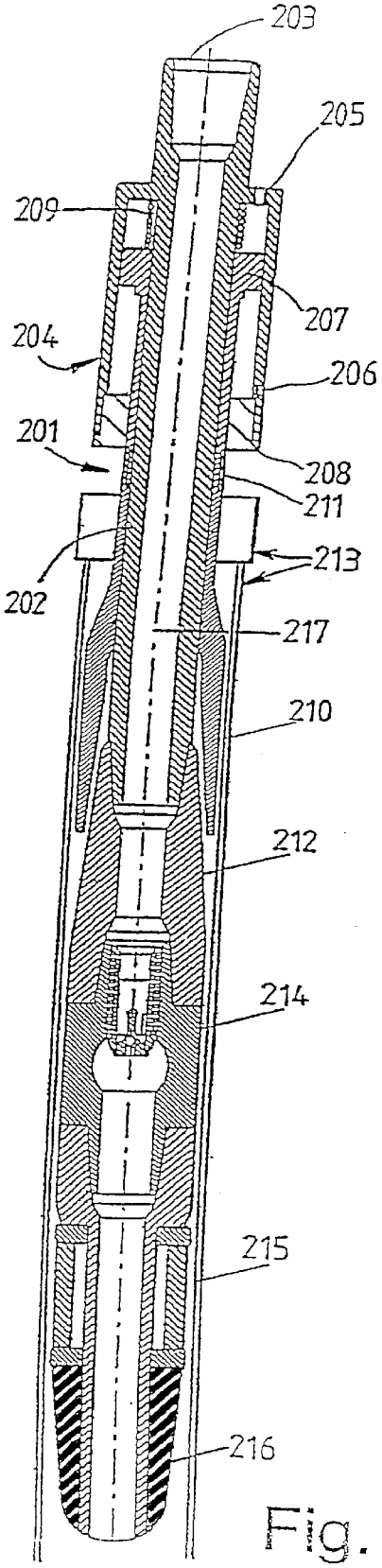
FIG. 1 shows a cross-sectional side view of an embodiment of an apparatus in accordance with the present invention.
Figure 2:
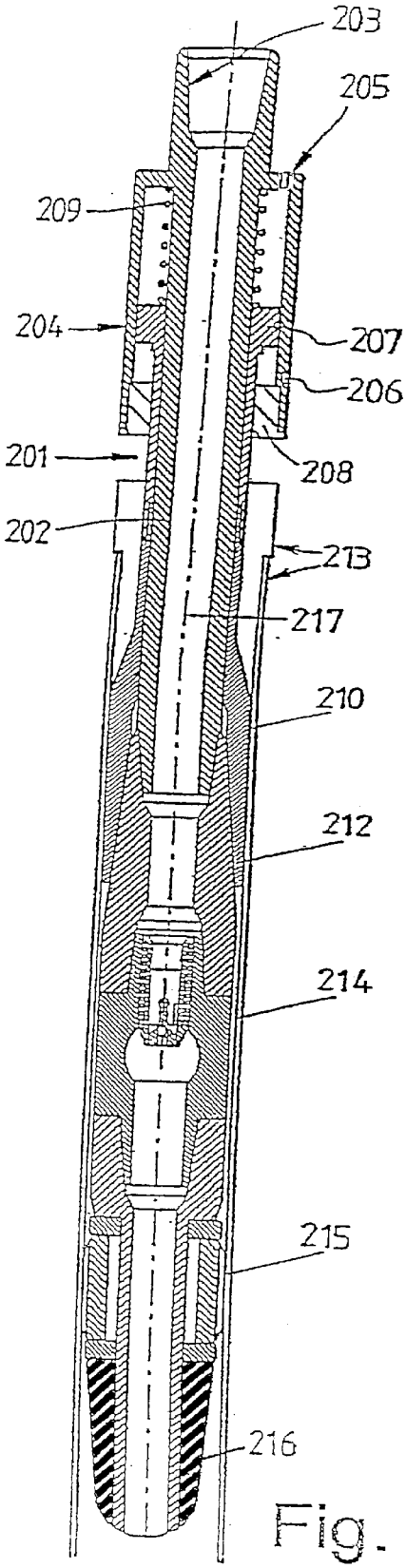
FIG. 2 shows a cross-sectional side view of the embodiment of FIG. 1 in use.

Referring to FIGS. 1 and 2 there is shown an apparatus in accordance with an embodiment of the present invention which is generally identified by the reference numeral 201.

The apparatus comprises a cylindrical body 202 with a threaded connection 203 at the upper end for connection to a top drive. Attached to the cylindrical body 202, or machined into it, is a hydraulic cylinder 204, with threaded ports 205, 206 at opposite ends. These ports 205 and 206 permit hydraulic fluid to be injected under pressure to manipulate a hydraulic piston 207, secured within the cylinder by a threaded lock ring 208. A compression spring 209 is located in the cylinder 204 above the piston 207.

A grapple 210, provided with serrated teeth machined into its outer surface, is provided around the cylindrical body 202 below the hydraulic cylinder 204. The grapple 210 is connected to the hydraulic piston 207 by a threaded connection 211. A corresponding wedge lock 212 is provided on the cylindrical body 202. The grapple 210 and corresponding wedge lock 212 are located, in use, inside a casing 213. The piston 207 and lock ring 208 are fitted with seal rings (not shown) to prevent hydraulic fluid leakage.

A mud-check valve 214 is thread connected at the lower end of the wedge lock 212. Below this valve is a rubber pack-off assembly 215. These prevent spillage of drilling fluid when the apparatus 201 is removed from within the casing joint 213. The pack-off 215 can be energised by either internal mud pressure or external mud flow.

In use, the apparatus 201 is lowered into the casing joint 213 as shown in FIG. 1. The grapple 210 is held out of contact with the wedge lock 212 by hydraulic fluid injected into port 206.

When the apparatus 201 is located at the correct installation depth within the casing 213, the pressure and fluid is released from port 206, and fluid is injected into port 205. This pushes the piston 207 downwards, pressing the grapple 210 against the wedge lock 212. The grapple 210 is forced outwards by the wedge lock 212, forming a mechanical friction grip against the inner wall of the casing 213. This is shown in FIG. 2.

The rig lifting equipment (not shown) raises the apparatus 201, and this causes the wedge lock 212 to be pulled upwards against the inner surface of the grapple 210, ensuring that constant outward pressure is applied to the grapple 210. The grip becomes tighter with increasing pull exerted by the rig lifting equipment.

Should hydraulic pressure be lost from port 205, the compression spring 209 ensures that the piston 207 continues to press the grapple 210 against the wedge lock 212, preventing release of the grapple from the wedge lock.

The apparatus 201 and casing 213 are then lowered into the well bore and the casing is secured. The apparatus 201 is lowered so that it supports its own weight only, and hydraulic fluid is then pumped out of port 205 and into port 206 to release the grapple 210 from the wedge lock 212 and thus release the apparatus 201 from the casing 213. The apparatus is then removed from the casing joint 213 and the process is repeated.

Figure 3:
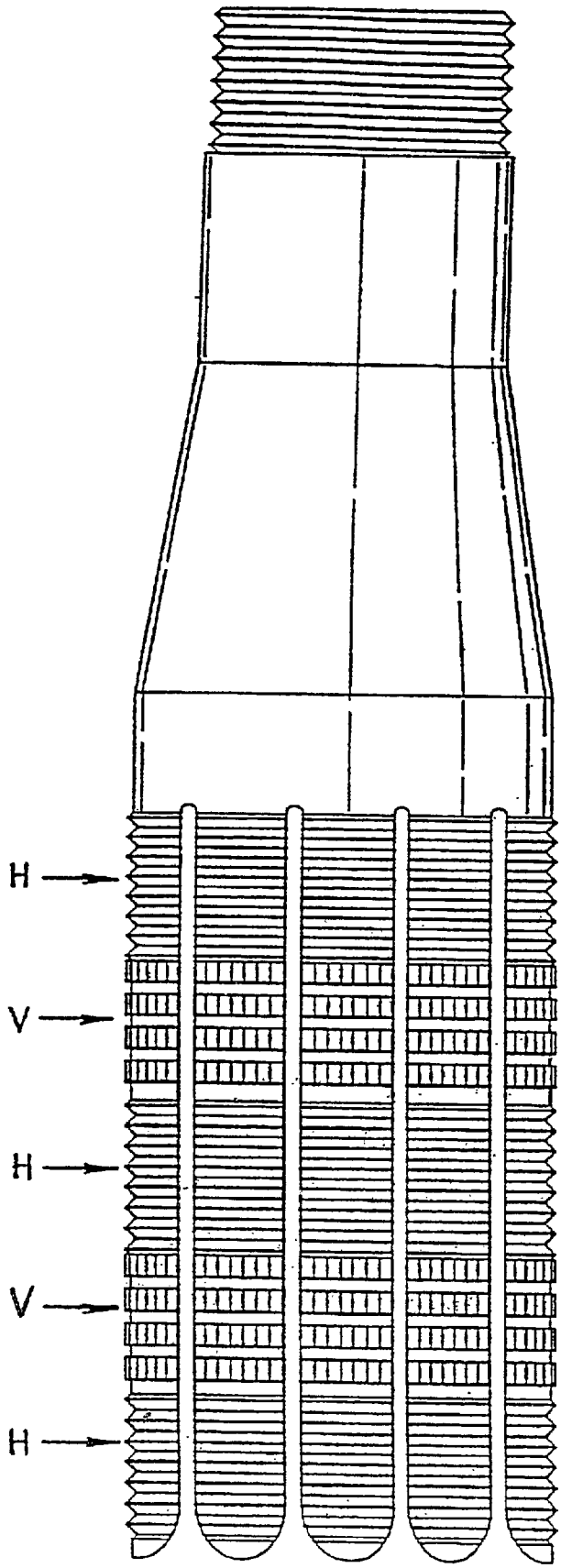
FIG. 3 shows a front elevational view of a grapple having both horizontal and vertical whickers or serrated teeth.

FIG. 3 illustrates in more detail the grapple 210. At its lower end, a number of elongate gripping members depend from the main body of the grapple. The outer surface of each gripping member is provided with alternating sets of vertical and horizontal whickers or teeth for gripping the inner surface of the tubular.

What is claimed is:

1. An apparatus for running tubulars into a borehole, said apparatus comprising a body provided with a wedge lock assembly and a hydraulically operable grapple to mechanically grip the inside wall of a tubular to be run into, or withdrawn from, the borehole, said grapple incorporating positive locking means to prevent inadvertent release of said grapple, said body further comprising means to prevent spillage of drilling fluid when the body is withdrawn from the tubular, a sealing packer for engagement with the tubular to permit fluid to be circulated within the tubular, and a stabbing guide, characterised in that said grapple comprises horizontal and vertical whickers or serrated machined teeth for transmission of both torque and lift to a gripped tubular in use, and said stabbing guide is a rubber stabbing guide to prevent damage when entering a tubular, wherein the grapple is connected to a hydraulic piston assembly to permit engagement of the grapple with the inside walls of the tubular to enable mechanical lift to be applied to the tubular, and wherein the hydraulic piston assembly is biased towards a failsafe position by a compression spring.

2. The apparatus as claimed in claim 1, wherein said hydraulic piston assembly has two positions.

3. The apparatus as claimed in claim 1, wherein the hydraulic piston assembly incorporates a cylinder which is either formed integrally with the body or is attached thereto by threading or flanging.

4. The apparatus as claimed in claim 1, wherein the body is provided with a slip-ring assembly to enable hydraulic fluid to be supplied to the hydraulic piston assembly whilst at the same time permitting rotation of the body and the tubular thereon.

5. The apparatus as claimed in claim 1, and which is adapted to be used with different sizes of tubular.

6. The apparatus as claimed in claim 1, wherein the body is fitted with a bull-nose guide to prevent damage to the top of the tubular when the body is introduced into the tubular.

7. The apparatus as claimed in claim 1, wherein the body is provided with a through bore to permit circulation of fluid.

8. An apparatus for running tubulars into a borehole, the apparatus comprising:

a body provided with a wedge lock assembly and a hydraulically operable grapple to mechanically grip the inside wall of a tubular to be run into, or withdrawn from, the borehole, said grapple incorporating positive locking means to prevent inadvertent release of said grapple, said body further comprising means to prevent spillage of drilling fluid when the body is withdrawn from the tubular, a sealing packer for engagement with the tubular to permit fluid to be circulated within the tubular, and a stabbing guide, wherein the grapple is connected to a hydraulic piston assembly to permit engagement of the grapple with the inside walls of a tubular to enable mechanical lift to be applied to the tubular, and the hydraulic piston assembly is biased towards a failsafe position by a compression spring.

9. The apparatus as claimed in claim 8, wherein said hydraulic piston assembly has two positions.

10. The apparatus as claimed in claim 8, wherein the hydraulic piston assembly incorporates a cylinder which is either formed integrally with the body or is attached thereto by threading or flanging.

11. The apparatus as claimed in claim 8, wherein the body is provided with a slip-ring assembly to enable hydraulic fluid to be supplied to the hydraulic piston assembly whilst at the same time permitting rotation of the body and the tubular thereon.

12. The apparatus as claimed in claim 8, and which is adapted to be used with different sizes of tubular.

13. The apparatus as claimed in claim 8, wherein the body is fitted with a bull-nose guide to prevent damage to the top of the tubular when the body is introduced into the tubular.

14. The apparatus as claimed in claim 8, wherein the body is provided with a through bore to permit circulation of fluid.

15. The apparatus as claimed in claim 8, wherein said grapple comprises horizontal and vertical whickers or serrated machined teeth for transmission of both torque and lift to a gripped tubular in use.

16. The apparatus as claimed in claim 8, wherein said stabbing guide is a rubber stabbing guide to prevent damage when entering a tubular.

* * * * *